US011794512B1

(12) United States Patent
Waggoner

(10) Patent No.: US 11,794,512 B1
(45) Date of Patent: Oct. 24, 2023

(54) MAGNETIC PAINTBRUSH OR TOOL HOLDER

(71) Applicant: Samuel David Waggoner, Pueblo, CO (US)

(72) Inventor: Samuel David Waggoner, Pueblo, CO (US)

( * ) Notice: Subject to any disclaimer, the term of this patent is extended or adjusted under 35 U.S.C. 154(b) by 0 days.

(21) Appl. No.: 17/728,010

(22) Filed: Apr. 25, 2022

(51) Int. Cl.
*B44D 3/12* (2006.01)
*B67B 7/14* (2006.01)

(52) U.S. Cl.
CPC ..... *B44D 3/123* (2013.01); *B67B 7/14* (2013.01)

(58) Field of Classification Search
CPC ..... B44D 3/126; B44D 3/123; B44D 3/125; B44D 3/12; B67B 7/14
USPC ..... 220/697, 699, 700, 695, 570, 736, 735; 15/236.03
See application file for complete search history.

(56) References Cited

U.S. PATENT DOCUMENTS

| | | | |
|---|---|---|---|
| 124,928 | A | 3/1872 | Bailey |
| 810,640 | A | 1/1906 | Greener |
| 955,646 | A | 4/1910 | Jorey |
| 1,125,931 | A | 1/1915 | Arnest |
| 1,176,009 | A | 3/1916 | Weimar |
| 1,713,077 | A | 5/1929 | Frizl |
| 1,865,283 | A | 6/1932 | Sohnle |
| 1,938,376 | A | 12/1933 | Dietrichs |
| 2,081,570 | A | 5/1937 | Akergren |
| 2,138,812 | A | 12/1938 | Akers et al. |
| 2,150,784 | A | 3/1939 | Roehm |
| 2,447,764 | A | 8/1948 | Mccain |
| 2,469,864 | A | 5/1949 | Craft et al. |
| 2,508,707 | A | 5/1950 | Davis |
| 2,529,257 | A | 11/1950 | Kerby |
| 2,535,260 | A | 12/1950 | Braswell |
| 2,605,986 | A | 8/1952 | Schulz |
| 2,803,374 | A | 8/1957 | Cash |
| 2,903,154 | A | 9/1959 | Hendershot |
| 2,911,016 | A | 11/1959 | Kenney |
| 3,029,054 | A | 4/1962 | Mott |
| 3,156,364 | A | 11/1964 | Wolcott |
| 3,185,311 | A | 5/1965 | Roberts et al. |
| 3,407,429 | A | 10/1968 | Di Nardo |
| 3,425,012 | A | 1/1969 | Gottinger |
| 3,428,213 | A | 2/1969 | Stephens |
| 3,536,285 | A | 10/1970 | Vaughn |
| 3,668,731 | A | 6/1972 | McBride |

(Continued)

FOREIGN PATENT DOCUMENTS

| | | |
|---|---|---|
| EP | 1556232 B1 | 2/2011 |

*Primary Examiner* — Robert J Hicks
(74) *Attorney, Agent, or Firm* — Williams Intellectual Propert; Benjamin Williams; Raphael Somost

(57) ABSTRACT

A tool holder includes a body having a posterior arm with a first longitudinal axis extending from a posterior arm proximal portion to a posterior arm distal end. The body includes an anterior arm having a second longitudinal axis extending from an anterior arm proximal portion to an anterior arm distal end. The anterior arm proximal portion includes an anterior arm offset portion having a third longitudinal axis that intersects the first longitudinal axis at or below a midpoint of the posterior arm. The body also includes a u-shaped portion joining the posterior arm distal end and the anterior arm distal end. At least one magnet is positioned on the anterior arm to connect to a paintbrush or other tool.

20 Claims, 7 Drawing Sheets

(56) References Cited

U.S. PATENT DOCUMENTS

| | | | |
|---|---|---|---|
| 3,729,158 | A | 4/1973 | Nagy |
| 4,101,046 | A | 7/1978 | Puntillo |
| 4,116,332 | A | 9/1978 | Hartley |
| 4,266,686 | A | 5/1981 | Carter |
| 4,275,818 | A | 6/1981 | Church |
| 4,436,217 | A | 3/1984 | Ritter |
| 4,860,891 | A | 8/1989 | Biggio |
| 5,016,773 | A | 5/1991 | Lockwood |
| 5,033,704 | A | 7/1991 | Kerr |
| 5,072,868 | A | 12/1991 | Dickie et al. |
| 5,085,386 | A | 2/1992 | Hicks et al. |
| 5,207,348 | A | 5/1993 | Fishcer et al. |
| 5,253,768 | A | 10/1993 | Traversa et al. |
| 5,341,969 | A | 8/1994 | Accardo et al. |
| 5,406,668 | A | 4/1995 | Goodhue |
| 5,413,296 | A | 5/1995 | Lafontaine |
| 5,568,879 | A | 10/1996 | Kovathana |
| 6,135,310 | A | 10/2000 | Svehaug |
| 6,175,987 | B1 | 1/2001 | Harvey |
| 6,616,110 | B1 | 9/2003 | McIntee |
| 6,681,952 | B2 | 1/2004 | Mowe |
| 6,820,848 | B1 | 11/2004 | Adam |
| 7,172,090 | B2 | 2/2007 | Jackson |
| 7,559,513 | B2 | 7/2009 | Kovall |
| 2002/0185509 | A1* | 12/2002 | Wichman ..... A45F 5/00 224/679 |
| 2004/0173627 | A1 | 9/2004 | Kesling |
| 2005/0156085 | A1 | 7/2005 | Radovan |
| 2005/0161460 | A1 | 7/2005 | Depasquale et al. |
| 2005/0184077 | A1 | 8/2005 | Martinson |
| 2005/0269469 | A1 | 12/2005 | Cummins |
| 2007/0285824 | A1 | 12/2007 | Cornelissen |
| 2009/0314788 | A1 | 12/2009 | Douglas |
| 2011/0147394 | A1 | 6/2011 | Thorp |
| 2012/0069696 | A1 | 3/2012 | Van Geer |
| 2016/0368312 | A1 | 12/2016 | Cooper |
| 2020/0016923 | A1 | 1/2020 | Lewan |

* cited by examiner

MAGNETIC PAINTBRUSH OR TOOL HOLDER

BACKGROUND OF THE INVENTION

Home improvement and construction projects rely on various handheld tools to perform a variety of tasks. Hammers, screwdrivers, wrenches, paintbrushes, among other tools, are used intermittently and need to be easily available when not in use. Oftentimes, projects are performed in tight spaces or on ladders where space is limited. Other times, projects may be performed in cluttered areas where tools may be misplaced easily. Various types of paintbrush and tool holders are known in the prior art. For example, there are belts with pockets or fasteners, clips, and backpacks. However, these can be cumbersome and unnecessary when using a single tool. What is needed is a paintbrush or tool holder that is easy to use, lightweight, can be attached to a variety of supports, and includes a quick connect coupling system.

FIELD OF THE INVENTION

The present invention relates to tool holders, and more particularly, to a magnetic paintbrush or tool holder for supporting a paintbrush or tool while not in use.

SUMMARY OF THE INVENTION

In one aspect of the disclosure, a holder for a paintbrush may include a body having a posterior arm and an anterior arm. The posterior arm may include a first longitudinal axis extending from a posterior arm proximal portion to a posterior arm distal end. The anterior arm may include a second longitudinal axis extending from an anterior arm proximal portion to an anterior arm distal end. The anterior arm proximal portion may include an anterior arm offset portion having a third longitudinal axis that intersects the first longitudinal axis at or below a midpoint of the posterior arm. The body may include a u-shaped portion joining the posterior arm distal end and the anterior arm distal end. The holder may include at least one magnet positioned on the anterior arm. A removable cap can be configured to cover the at least one magnet. The posterior arm proximal portion may include a posterior arm offset portion having a fourth longitudinal axis offset from the first longitudinal axis. The body may comprise metal, plastic, polymer, or a combination thereof. In one aspect, a length of the posterior arm from the posterior arm proximal portion to the posterior arm distal end may be longer than a length of the anterior arm from the anterior arm proximal portion to the anterior arm distal end. In another aspect, a length of the posterior arm from the posterior arm proximal portion to the posterior arm distal end may be substantially the same as the length of the anterior arm from the anterior arm proximal portion to the anterior arm distal end. The anterior arm proximal portion may be configured to abut the posterior arm at or below the midpoint of the posterior arm. In one aspect, the body can be rigid. In another aspect, the body can be resilient. The at least one magnet may be positioned at or above a midpoint of the anterior arm.

In another aspect, a tool holder can include a body having a posterior arm and an anterior arm. The posterior arm may include a posterior arm distal end and at least one bend. The anterior arm may include a longitudinal axis extending from an anterior arm proximal portion to an anterior arm distal end, the anterior arm proximal portion may include an anterior arm offset portion having a second longitudinal axis that is offset from the first longitudinal axis. The body may include a u-shaped portion joining the posterior arm distal end and the anterior arm distal end. The tool holder may include at least one magnet positioned on the anterior arm between a midpoint of the anterior arm and the anterior arm distal end. The holder may include a cap configured to cover the at least one magnet. The body may comprise metal, plastic, polymer, or a combination thereof. The anterior arm proximal portion may be configured to abut the posterior arm at or below a midpoint of the posterior arm. In one aspect the body may be rigid. In another aspect the body may be resilient. In yet another aspect the body may be flexible. The at least one magnet may comprise a first and second magnet. In one aspect, the at least one bend may include a first bend, a second bend, and a third bend forming a recurve portion of the posterior arm. In one aspect, a length of the posterior arm from the posterior arm distal end to a posterior arm proximal portion may be longer than a length of the anterior arm from the anterior arm distal end to the anterior arm proximal portion. In another aspect, a length of the posterior arm from the posterior arm distal end to a posterior arm proximal portion may be substantially the same as a length of the anterior arm from the anterior arm distal end to the anterior arm proximal portion. The posterior arm proximal portion may be configured to pry open a paint can.

Objects of the present paintbrush holder or tool holder, along with various novel features that characterize the invention are particularly pointed out in the claims forming a part of this disclosure. For better understanding of the paintbrush holder or tool holder, its operating advantages and specific objects attained by its uses, refer to the accompanying drawings and description.

DETAILED DESCRIPTION OF THE DRAWINGS

With reference now to the FIGS. 1 through 7, an example of the instant paintbrush or tool holder employing the principles and concepts of the present paintbrush or tool holder and generally designated by the reference number 100 will be described.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Referring to FIGS. 1 through 7, a preferred embodiment of the paintbrush or tool holder 100 is illustrated.

Figure 1:
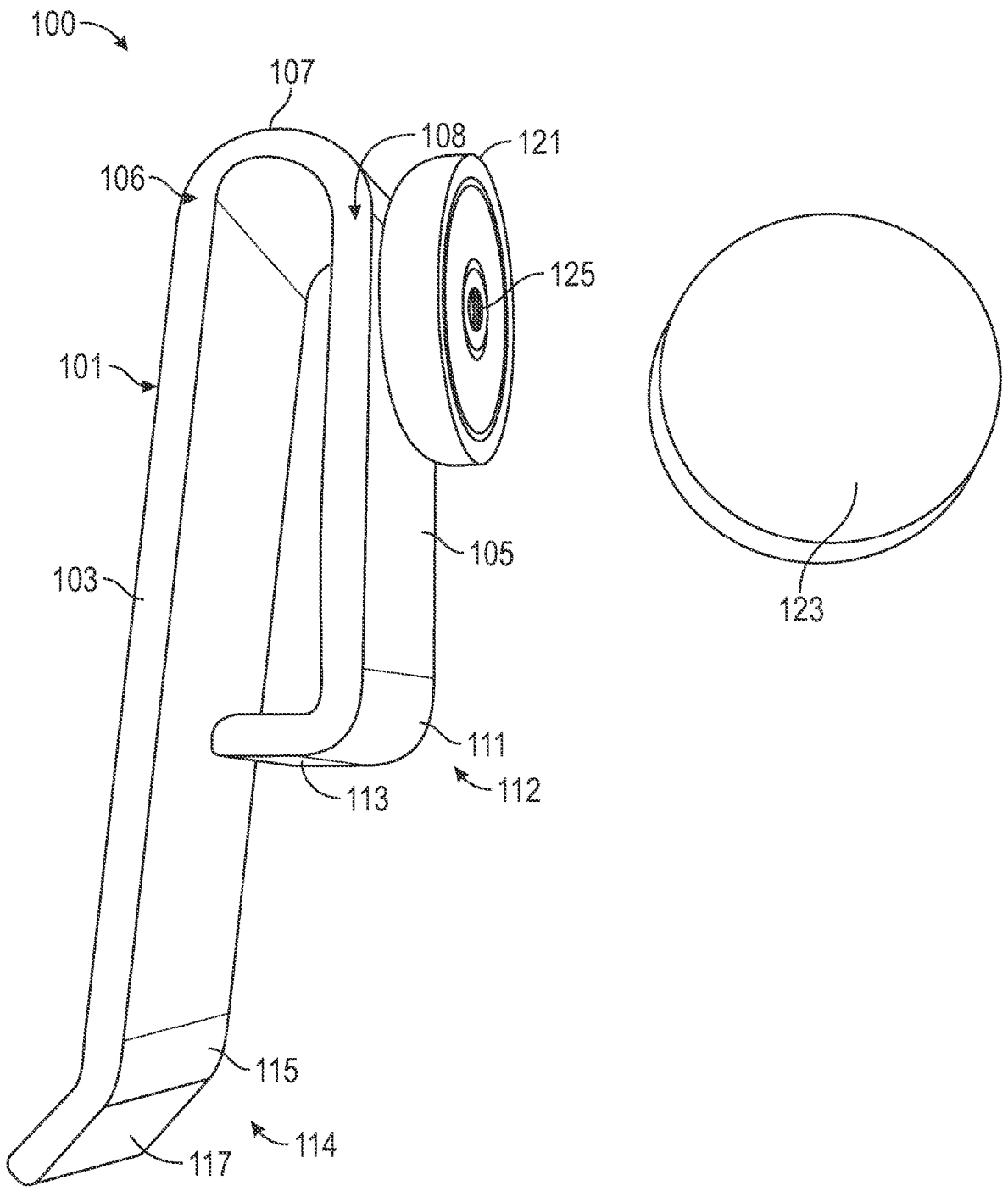
FIG. 1 is an isometric view illustrating a paintbrush or tool holder having magnet with a removable cap, with the cap removed.
Figure 2:
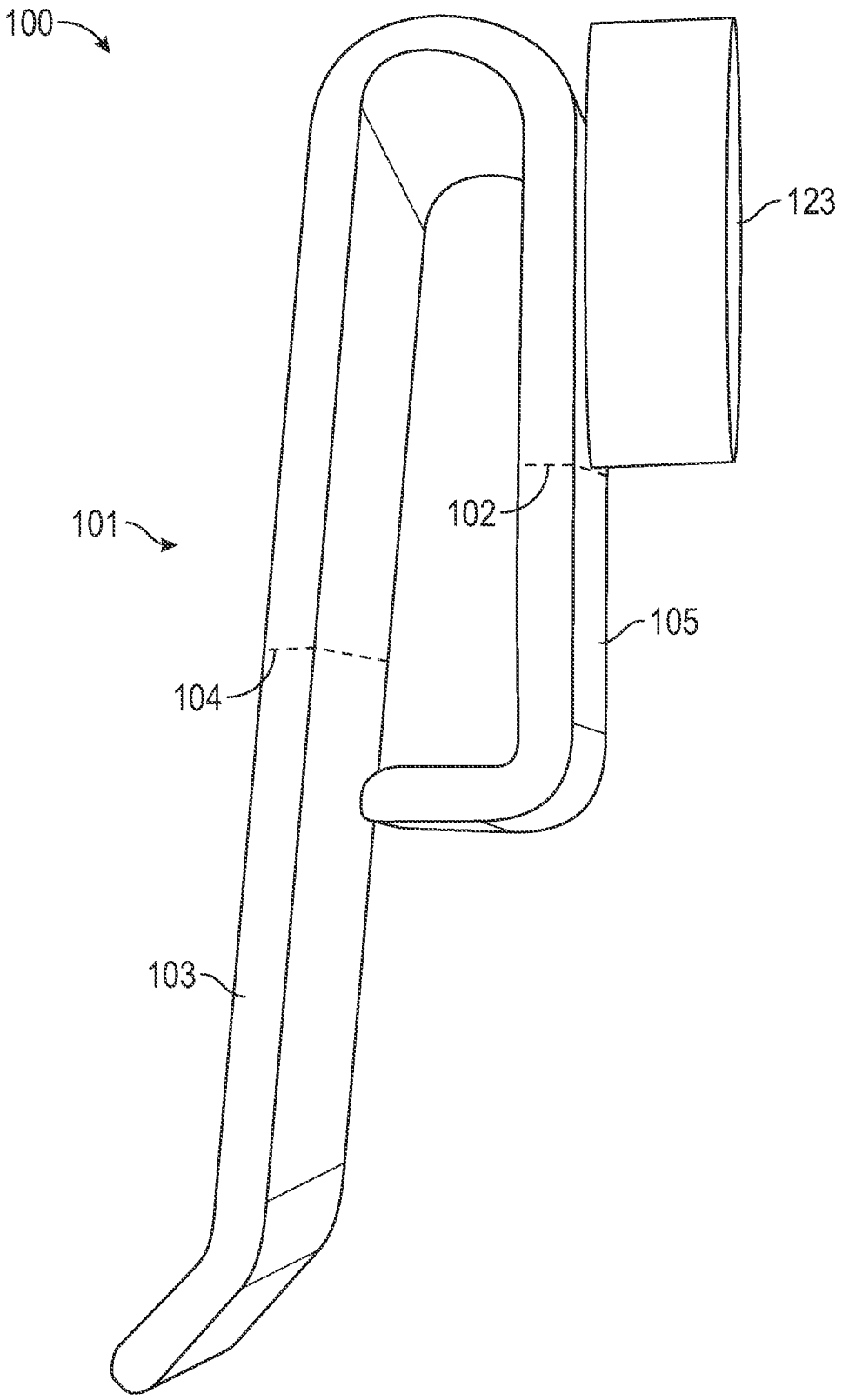
FIG. 2 is an isometric view illustrating the paintbrush or tool holder of FIG. 1 with the cap installed.

FIG. 1 illustrates a holder 100 for a paintbrush or tool that may include a body 101 having a posterior arm 103 and an anterior arm 105. The posterior arm 103 may include a first longitudinal axis (illustrated as 201 in FIG. 4) extending from a posterior arm proximal portion 114 to a posterior arm distal end 106. In some embodiments, the posterior arm may include a first bend, a second bend, and a third bend forming a recurve portion of the posterior arm. The anterior arm 105 may include a second longitudinal axis (illustrated as 202 in FIG. 4) extending from an anterior arm proximal portion 112 to an anterior arm distal end 108.

Figure 3:
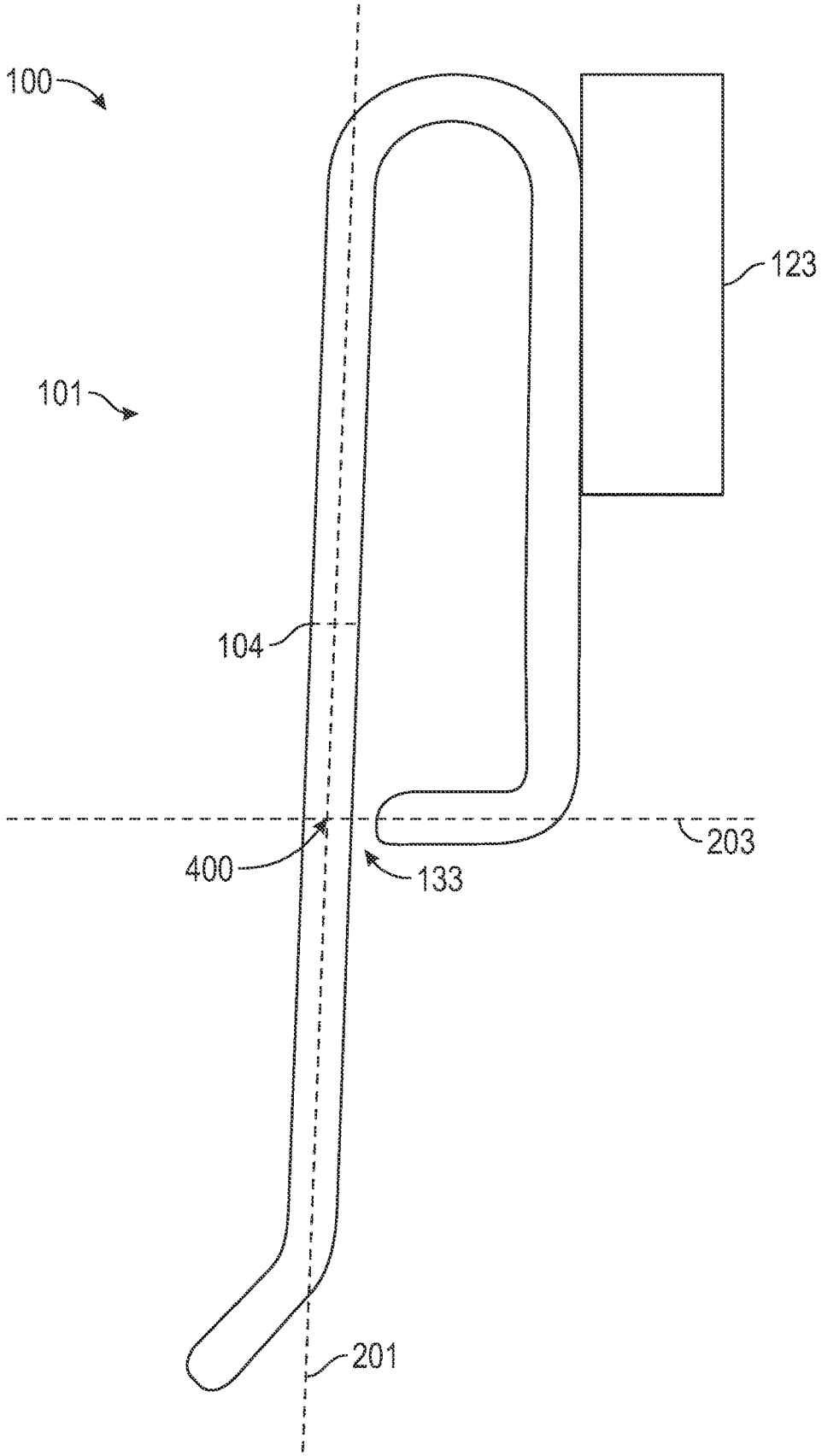
FIG. 3 illustrates a left-side view of the paintbrush or tool holder of FIG. 1.

The posterior arm proximal portion may include a posterior arm bend 115 and a posterior arm offset portion 117. The anterior arm proximal portion 112 may include an anterior arm bend 111 and an anterior arm offset portion 113 having a third longitudinal axis (illustrated as 203 in FIGS. 3 and 4) that intersects the first longitudinal axis 201 at or below a midpoint 104 of the posterior arm 103. FIG. 3 illustrates where first longitudinal axis 201 and third longitudinal axis 203 intersect at 400.

The body 101 may include a u-shaped portion 107 joining the posterior arm distal end 106 and the anterior arm distal end 108. While the u-shaped portion 107 is shown as having a smooth curve, the u-shaped portion could also include a v-shape or could include a linear member that is substantially orthogonal or perpendicular to both the posterior arm 103 and the anterior arm 105.

The holder 100 may include at least one magnet 121 positioned on the anterior arm 105. The magnet 121 may be circular in shape as shown, or may include another shape such as an oval, rectangle, square, polygonal, or irregular. The magnet 121 may is include a central opening to receive a screw or other fastening member 125 to join the magnet 121 to the anterior arm 105. Alternatively, the magnet 121 may be adhered to the anterior arm 105 by a glue or adhesive. The magnet 121 can be formed of any magnetic material, for example neodymium, alnico, ferrite neodymium, samarium cobalt, and combinations thereof that are configured to be attracted to metals forming common hand tools or paintbrushes. The at least one magnet 121 may be positioned at or above a midpoint 102 of the anterior arm 105.

A removable cap 123 can be configured to cover the at least one magnet 121. The posterior arm proximal portion 114 may include a posterior arm offset portion 117 having a fourth longitudinal axis (illustrated as 204 in FIG. 4) offset from the first longitudinal axis 201.

The body 101 may comprise metal, plastic, polymer, or a combination thereof. For example, in one embodiment the body 101 may include a core formed of a metal, such as steel, aluminum, or stainless steel surrounded by a polymer such as silicone to form a protective coating that is easy to clean and can increase friction on the surface for ease of gripping or increase shock absorbing properties. In another embodiment, the body 101 may be entirely formed by additive manufacturing or injection molding using one or more polymeric materials or plastics.

The body 101 may have a solid cross-section, or may be formed in a tubular configuration with a hollow interior. The cross-section may be rectangular, oval, circular, square, trapezoidal, or other polygonal shape. The corners may be square or may be chamfered.

In one aspect, a length of the posterior arm 103 from the posterior arm proximal portion 114 to the posterior arm distal end 106 may be longer than a length of the anterior arm 105 from the anterior arm proximal portion 112 to the anterior arm distal end 108. In another aspect, a length of the posterior arm 103 from the posterior arm proximal portion 114 to the posterior arm distal end 106 may be substantially the same as the length of the anterior arm 105 from the anterior arm proximal portion 114 to the anterior arm distal end 112.

The body 100 can be configured to be placed on a support surface, such as a wall of a paint can, on a belt of a user, a support of a ladder, or any other easily accessible support surface. The u-shaped portion 107 is configured to rest on or near the support surface. In one aspect, the anterior arm 105 and the posterior arm 103 are configured to grip the support surface. In another aspect, the anterior arm offset portion 113 may be configured to pass under the support surface so that the body 101 surrounds the support surface, as is the case when the support surface is a belt or other narrow support. In one aspect, the body 100 can be rigid. In another aspect, the body 100 can be resilient or flexible so as to return to a first position after being expanded when being placed on a support surface.

Figure 5:
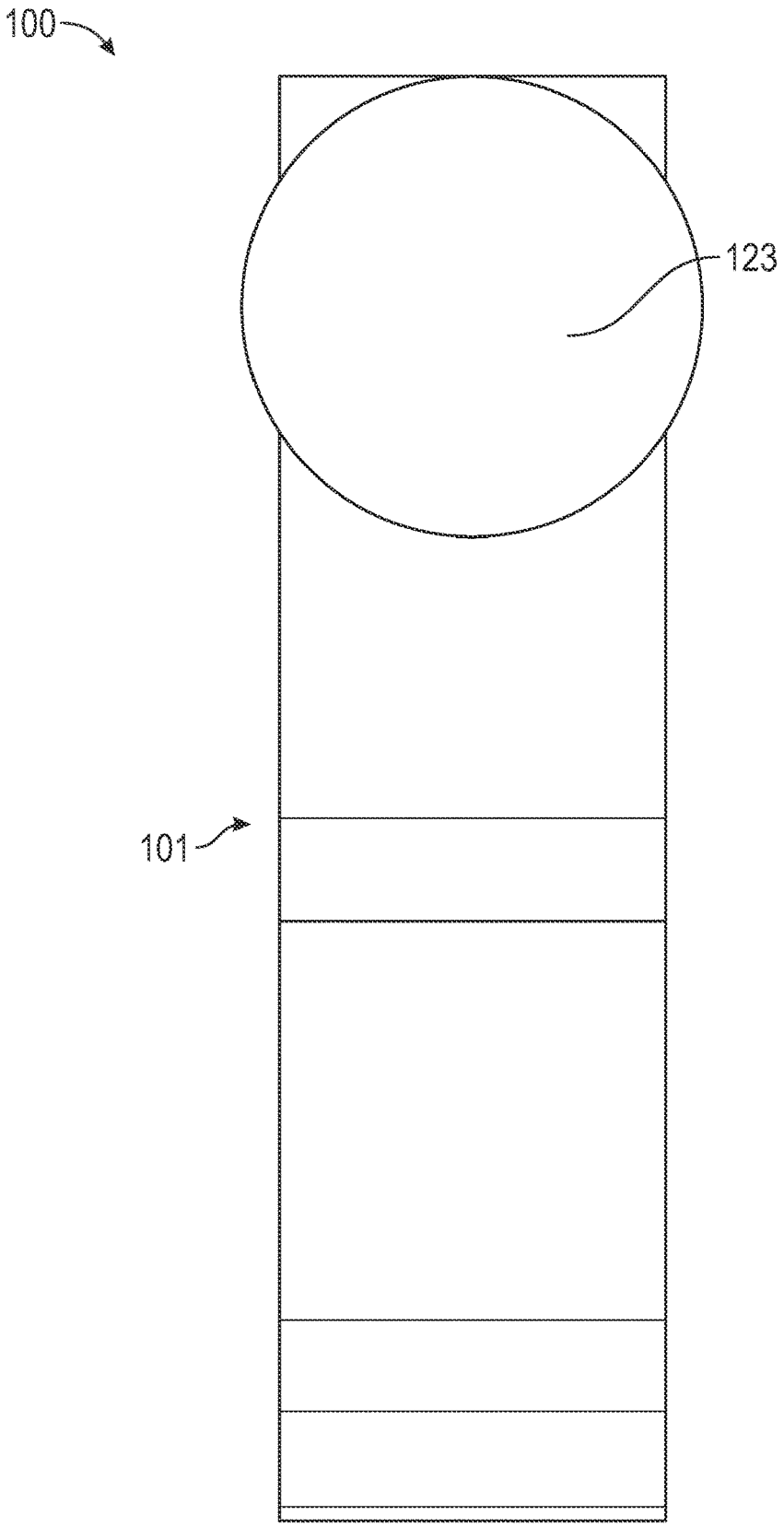
FIG. 5 illustrates a front view of the paintbrush or tool holder of FIG. 1.
Figure 6:
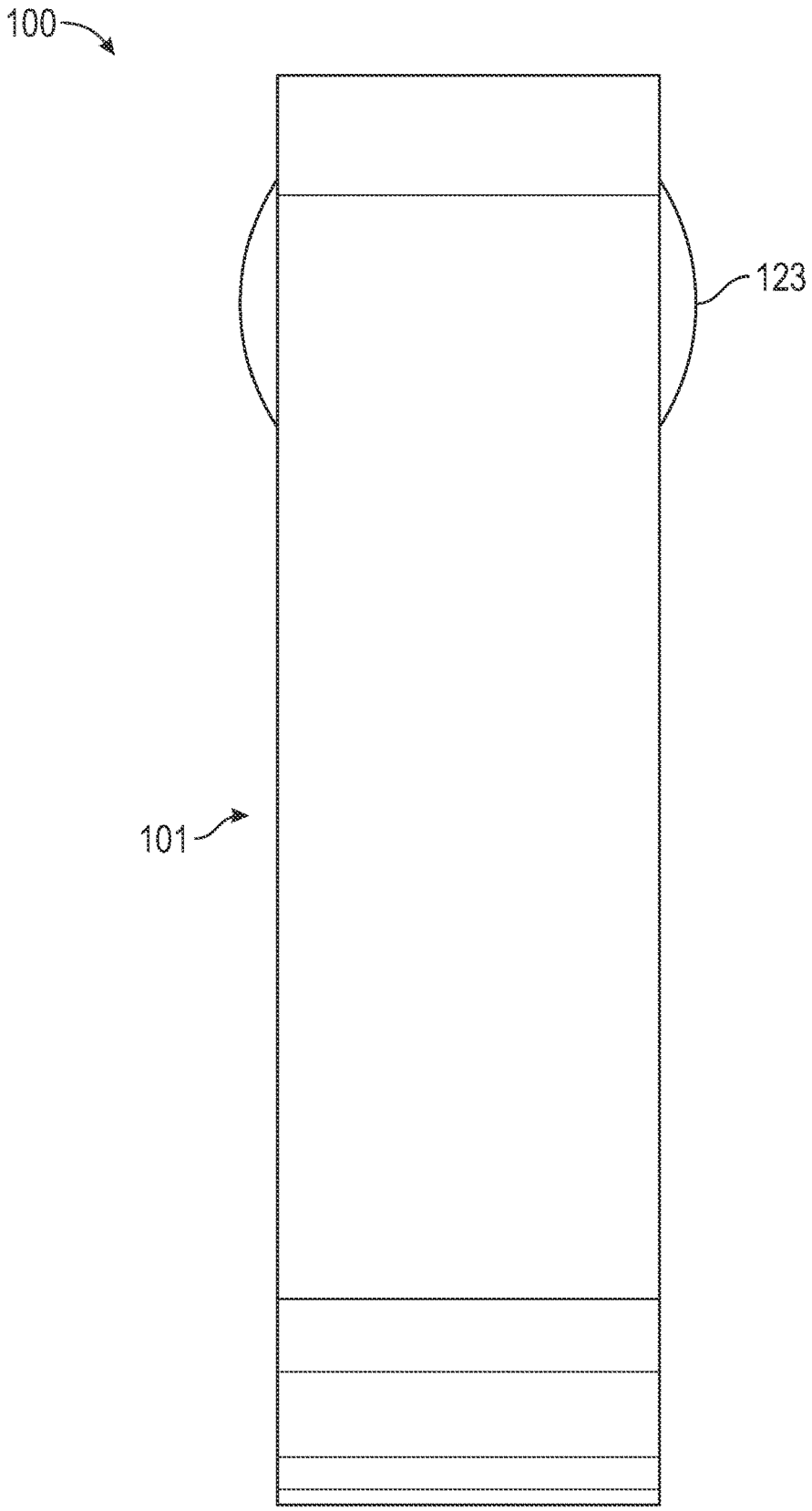
FIG. 6 illustrates a back view of the paintbrush or tool holder of FIG. 1.

As shown in FIG. 5, the at least one magnet 121 and removable cap 123 may include a diameter that exceeds the width w of the body 101. Having a large diameter magnet allows for an increased holding strength when connected to the metal of a paint can for example. The at least one magnet 121 is configured to be positioned above a midpoint 102 of the anterior arm 105. In some embodiments the at least one magnet may be attached to the anterior arm 105 below the anterior arm distal end 108 and a top of the at least one magnet 121 may extend above the u-shaped portion 107. In other embodiments the top of the at least one magnet 121 may be substantially flush with the u-shaped portion 107 or below the u-shaped portion 107 This configuration allows for the positioning of a paintbrush or other tool at the highest possible location. The at least one magnet 121 may include a first and second magnet positioned close to one another to increase the magnetic field and therefore holding capacity of the paintbrush or tool holder 100.

The removable cap 123 is shown as having a shape substantially similar to the shape of the magnet 121. However, in other embodiments, the removable cap may be configured to have a shape different than the shape of the magnet 121. For example, the removable cap 123 may be configured as a square, oval, rectangle, polygon, or other shape such as a beer bottle, female silhouette, mascot of a sports team, or brand logo. The removable cap 123 may be formed of an easily cleanable material. In some embodiments, the removable cap 123 can be formed of the same material as the body 101. In other embodiments, the removable cap 123 can be formed of a material different than the body 101.

The removable cap 123 may be configured to connect with the magnet 121 by one or more connecting mechanisms, such as a threaded connection, a ridge or groove, or other snap-fit connection. Alternatively, the removable cap 123 can be configured to friction fit over the magnet 121 to remain in place. In some embodiments, the removable cap 123 can include a textured surface having one or more raised or recessed portions to increase friction between a paintbrush or tool attached to the holder 100.

FIG. 3 illustrates a left-side view of the paintbrush or tool holder 100. A gap 133 is shown between the anterior arm offset portion 113 and the posterior arm 103. In some embodiments, the gap 133 may include a range of 1 mm to 10 mm. A larger spacing allows for ease of placing the holder 100 over wide supports, while a smaller spacing allows for an increase in gripping when placed on a support. In some embodiments, the anterior arm offset portion 113 is configured to abut the posterior arm 103 at or below the midpoint 104 of the posterior arm 103. In such embodiments, there is no gap 133.

Figure 4:
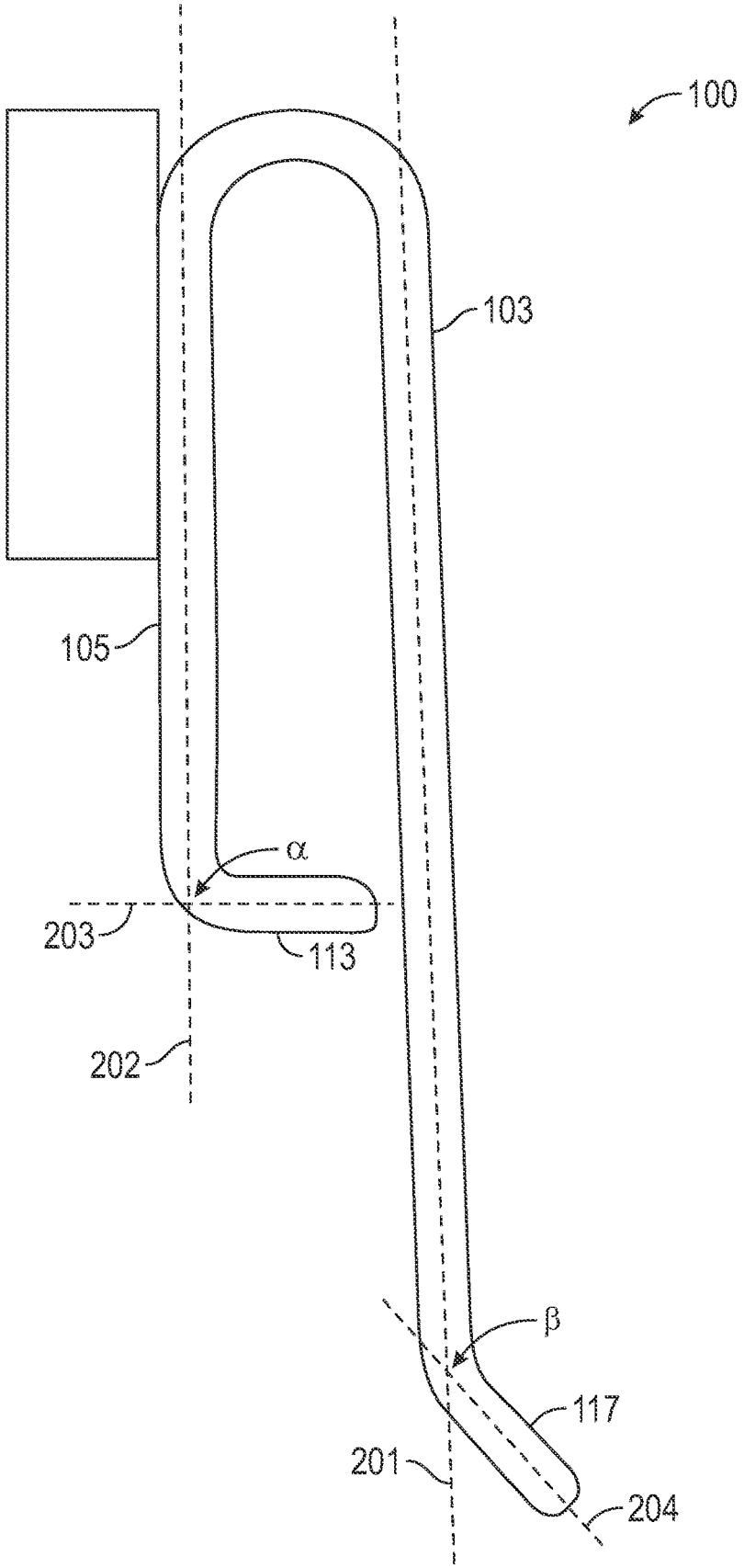
FIG. 4 illustrates a right-side view of the paintbrush or tool holder of FIG. 1.

FIG. 4 illustrates a right-side view of the paintbrush or tool holder 100. Posterior arm 103 includes a first longitudinal axis 201 extending from the posterior arm distal end 106 to the posterior arm bend 115. The posterior arm offset portion 117 is configured to remove paint can lids and includes a fourth longitudinal axis 204 which is offset from the first longitudinal axis 201 by angle β. β can be in the range of approximately 90 degrees to approximately 179 degrees, more preferably in the range of approximately 110 degrees to approximately 160 degrees, and more preferably in the range of approximately 120 degrees to approximately 150 degrees. Such an angle, β, allows for greater leverage and increases an ability of a user to pry open conventional paint can lids.

Also viewed in FIG. 4 is the second longitudinal axis 202 of the anterior arm 105 that extends from the anterior arm distal end 106 to the anterior arm bend 111. The anterior arm offset portion 113 includes a third longitudinal axis 203 that is offset from the second longitudinal axis 202 by angle α. α can be in the range of approximately 110 degrees to approximately 10 degrees, more preferably in the range of approximately 105 degrees to approximately 30 degrees, and more preferably in the range of approximately 95 degrees to approximately 50 degrees. Such an angle, a, allows for a secure fit between the holder 100 and the wall of a paint can or other support surface, such as a belt of a user.

Figure 7:
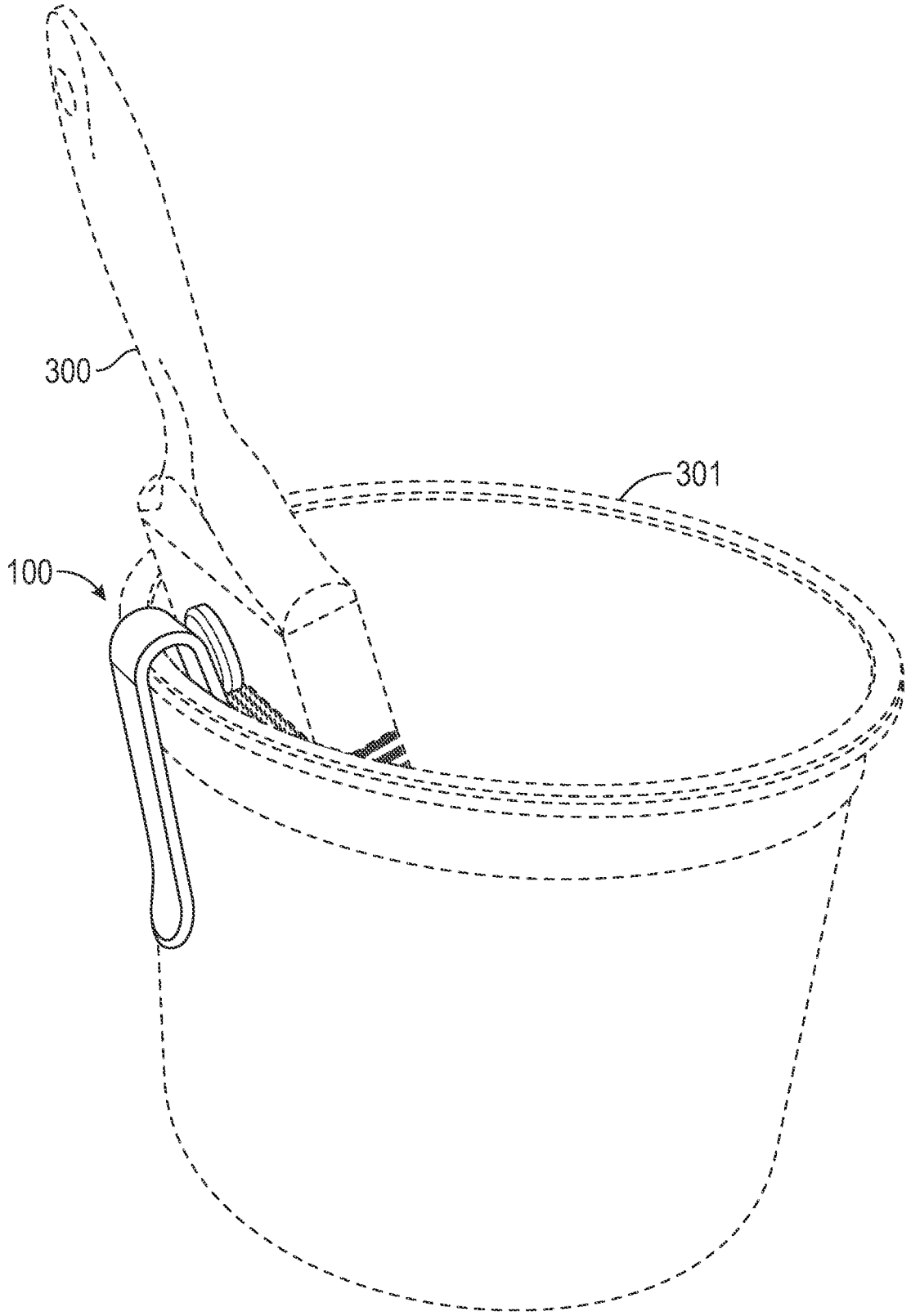
FIG. 7 illustrates an isometric view illustrating the paintbrush or tool holder of FIG. 1 positioned on a rim of a paint can.

FIG. 7 illustrates the paintbrush or tool holder 100 being used to support a paintbrush 300 while not in use. The holder 100 is mounted on a paint can 301. The posterior arm 103 and the anterior arm 105 grip the wall of the paint can 301 to hold the holder 100 in a stable positon. Such a holder 100 provides a convenient location to place an unused paintbrush.

Exemplary embodiments of this disclosure are described herein, including the best mode known to the inventors for carrying out the disclosure. Variations of those embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above described elements in all possible variations thereof is encompassed by the disclosure unless otherwise indicated herein or otherwise clearly contradicted by context.

The use of the terms "a" and "an" and "the" and similar referents in the context of describing the disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The terms "substantially" and "approximately" include within 1, 2, 3, or 4 standard deviations. In certain embodiments, the terms "about," "substantially," or "approximately" means within 50%, 20%, 15%, %, 9%, 8%, 7%, 6%, 5%, 4%, 3%, 2%, 1%, 0.5%, or 0.05% of a given value or range. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

What is claimed is:

1. A holder for a paintbrush comprising:

a body, comprising:

a posterior arm having a first longitudinal axis extending from a posterior arm proximal portion to a posterior arm distal end;

an anterior arm having a second longitudinal axis extending from an anterior arm proximal portion to an anterior arm distal end, the anterior arm proximal portion including an anterior arm offset portion having a third longitudinal axis that intersects the first longitudinal axis at or below a midpoint of the posterior arm;

a u-shaped portion joining the posterior arm distal end and the anterior arm distal end; and at least one magnet positioned on the anterior arm.

2. The holder for a paintbrush of claim 1 further comprising:

a removable cap configured to cover the at least one magnet.

3. The holder for a paintbrush of claim 1, wherein the posterior arm proximal portion includes a posterior arm offset portion having a fourth longitudinal axis offset from the first longitudinal axis.

4. The holder for a paintbrush of claim 1, wherein the body comprises metal, polymer, or a combination thereof.

5. The holder for a paintbrush of claim 1, wherein a length of the posterior arm from the posterior arm proximal portion to the posterior arm distal end is longer than a length of the anterior arm from the anterior arm proximal portion to the anterior arm distal end.

6. The holder for a paintbrush of claim 1, wherein a length of the posterior arm from the posterior arm proximal portion to the posterior arm distal end is substantially the same as the length of the anterior arm from the anterior arm proximal portion to the anterior arm distal end.

7. The holder for a paintbrush of claim 1, wherein the anterior arm proximal portion is configured to abut the posterior arm at or below the midpoint of the posterior arm.

8. The holder for a paintbrush of claim 1, wherein the body is rigid.

9. The holder for a paintbrush of claim 1, wherein the at least one magnet is positioned at or above a midpoint of the anterior arm.

10. A tool holder comprising:

a body, comprising:

a posterior arm having a posterior arm distal end and at least one bend;

an anterior arm having a longitudinal axis extending from an anterior arm proximal portion to an anterior arm distal end, the anterior arm proximal portion including an anterior arm offset portion having a second longitudinal axis that is offset from the first longitudinal axis;

a u-shaped portion joining the posterior arm distal end and the anterior arm distal end; and at least one magnet positioned on the anterior arm between a midpoint of the anterior arm and the anterior arm distal end.

11. The tool holder of claim 10 further comprising:

a cap configured to cover the at least one magnet.

12. The tool holder of claim 10, wherein the body comprises metal, polymer, or a combination thereof.

13. The tool holder of claim 10, wherein the anterior arm proximal portion is configured to abut the posterior arm at or below a midpoint of the posterior arm.

14. The tool holder of claim 10, wherein the body is rigid.

15. The tool holder of claim 10, wherein the at least one magnet comprises a first and second magnet.

16. The tool holder of claim 10, wherein the at least one bend includes a first bend, a second bend, and a third bend forming a recurve portion of the posterior arm.

17. The tool holder of claim 10, wherein a length of the posterior arm from the posterior arm distal end to a posterior arm proximal end is longer than a length of the anterior arm from the anterior arm distal end to the anterior arm proximal portion.

18. The tool holder of claim 10, wherein a length of the posterior arm from the posterior arm distal end to a posterior arm proximal end is substantially the same as a length of the anterior arm from the anterior arm distal end to the anterior arm proximal portion.

19. The tool holder of claim 10, wherein the body is flexible.

20. The tool holder of claim 10, wherein the posterior arm includes a proximal portion configured to pry open a paint can.

* * * * *